US005087046A

United States Patent [19]

Mauch

[11] Patent Number: 5,087,046

[45] Date of Patent: Feb. 11, 1992

[54] NOVELTY GOLF GAME

[76] Inventor: Carolyn S. Mauch, 19163 Surrey La., Northville, Mich. 48167

[21] Appl. No.: 642,440

[22] Filed: Jan. 17, 1991

[51] Int. Cl.[5] ..... A63B 69/36

[52] U.S. Cl. ..... 273/178 R; 206/315.2; 206/315.9; 273/162 R

[58] Field of Search ..... 273/127 D, 127 R, 162 R, 273/213, 176 AA, 177 R, 177 A, 177 B, 178 R, 178 A, 178 B, 179 R, 179 A, 179 B, 179 C, 179 D, 179 E, 127 B, 184 A, 185 R; 272/8 N

[56] References Cited

U.S. PATENT DOCUMENTS 1,295,437 2/1919 Cogswell ..... 273/127 D
1,587,295 6/1926 Gammeter ..... 273/176 AA
1,830,936 11/1931 Faith ..... 273/162 R
3,033,571 5/1962 Botts ..... 273/127 D
3,104,879 9/1963 Jetton ..... 273/213
4,573,686 3/1986 Nakamats ..... 273/184 A

*Primary Examiner*—George J. Marlo
*Attorney, Agent, or Firm*—Reising, Ethington, Barnard, Perry & Milton

[57] ABSTRACT

A novelty golf game includes a combination instructional card and golf hole for use in a game in which a ball is selectively stroked with respect to the hole. The hole includes an instructional card formed as a foldable board having a base and two raised surface portions joined at a raised apex and the base and one of the two raised surface portions have holes therein forming an opening through which a golf ball can be stroked.

2 Claims, 1 Drawing Sheet 10
12
12a
14
14a
16
16a
18
18a
20
22
24
24a
24b
24c
26
26a
26b
26c
26e
28
30
30a
30b
32
34
36
36a
36b
38
40
42
44

NOVELTY GOLF GAME

FIELD OF THE INVENTION

This invention relates to novelty golf games and more particularly to novelty golf games in which a ball is hit into a target or hole and wherein a score system is used to reward a successful putt and a penalty is applied when the putt is missed.

BACKGROUND OF THE INVENTION

Several novelty golf games are known in which a ball is selectively stroked with respect to various holes on a golf course layout. The best known of these games is miniature golf which can take many forms but which normally has a platform arrangement for each of the holes including various obstacles.

Other examples of novelty golf games are set-forth in U.S. Pat. Nos. 3,858,888; 3,610,631; and 3,476,388.

While suitable for providing a level of user participation, each of the aforesaid novelty games lack a penalty aspect which will encourage higher skill levels by exposing the user of the game to personal risk factors if unsuccessful in putting the ball into a target hole.

Furthermore, prior novelty golfing games are limited to the actual stroking of the ball and counting of strokes.

SUMMARY OF THE INVENTION

A feature of the present invention is to provide a novelty golf game in which putting skill is measured against an external standard. More particularly, the present invention involves a putting method in which putting skill is measured against the clothing of a game participant and wherein a successful putt is rewarded by clothes retention and wherein a missed putt is penalized by removing an article of clothing from the game participant.

A further feature of the present invention is to provide a novelty golf game of the aforesaid method in which a putting target is utilized including a portion thereon arranged for viewing of game instructions and including another portion thereof defining a target hole.

Still another feature of the present invention is to provide such a putting target in the form of a flat, foldable member having three sides joined at apexes to form an upright target with one surface facing upwardly for locating game instructions in a viewing field and having two other surfaces forming an opening for defining a putting target hole.

Still another object of the present invention is to provide a target for a novelty golf game which includes a flat board having at least two fold lines thereon and a center piece which is removable from the board to form an opening across one of the fold lines such that when the flat board is folded one end of a target defines a golf hole that is fully open at both ground level and through a vertical height in excess of the diameter of the golf ball.

These and other features, objects and advantages of the present invention will be more apparent when taken in conjunction with the appended text along with the accompanying drawings wherein:

DETAILED DESCRIPTION OF A PREFERRED EMBODIMENT OF THE INVENTION

Figures 1, 2A, 2B, 2C:
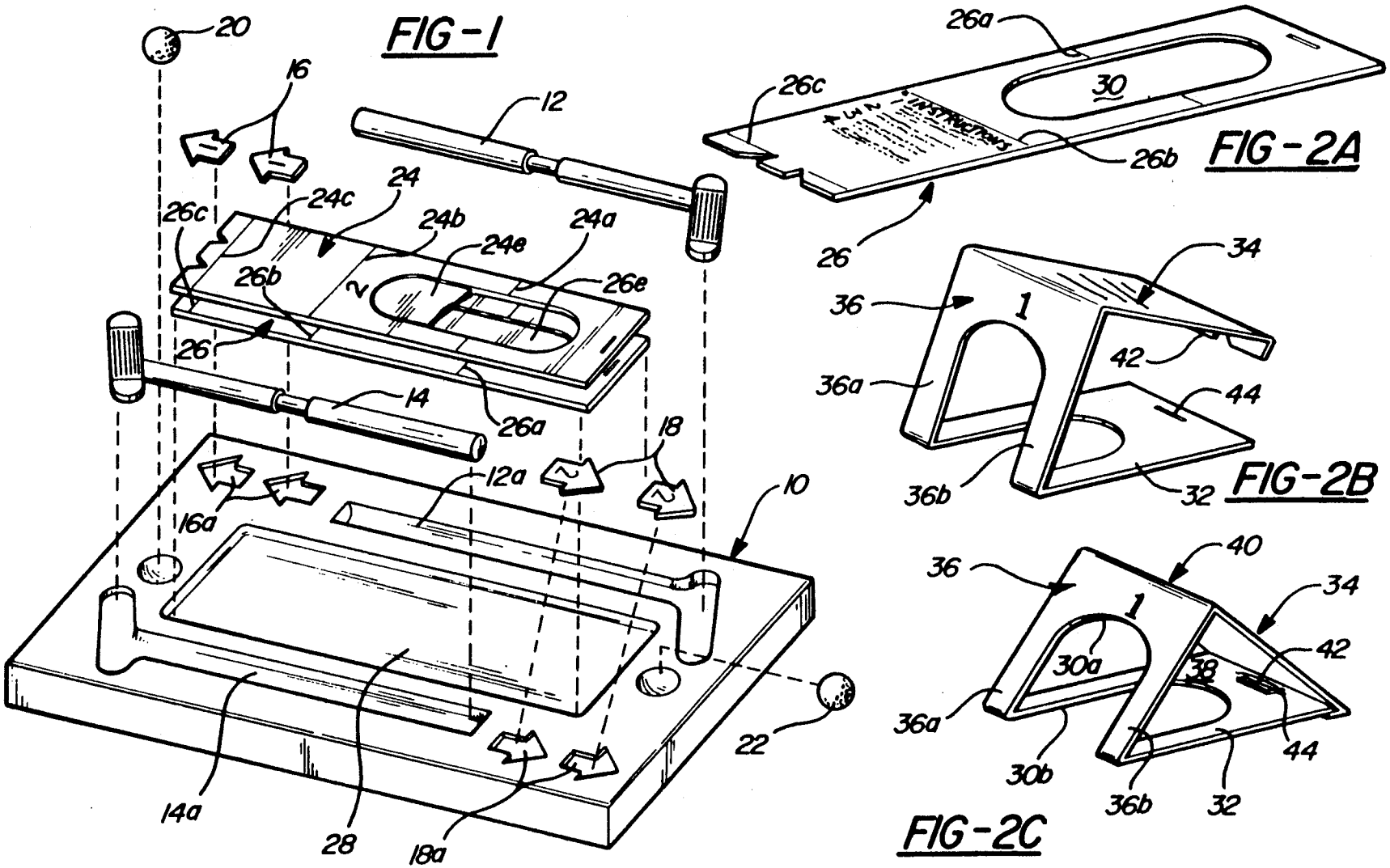
FIG. 1 is an exploded view of the component parts of a novelty golf game in accordance with the present invention.
FIG. 2A is a perspective view of a target hole prior to assembly.
FIG. 2B is a perspective view of a target hole as it is assembled.
FIG. 2C is a perspective view of a target hole following assembly.

Referring now to FIG. 1, a game container 10 is illustrated having a plurality of cavities for the game implements. The game implements include two miniature putters 12, 14 which seat in corresponding cavities 12*a*, 14*a* formed in the container 10. The cavities 12*a*, 14*a* are vacuum formed in a thin sheet of polypropylene or other suitable thermoformable plastic material.

In addition to the putters 12, 14 the game set includes two pairs of tee markers 16, 18 each received in matching, vacuum formed cavities 16*a*, 18*a* in the container 10 at opposite ends thereof. Two golf balls 20, 22 are provided each of which are stored in matching semi-spherical, vacuum formed cavities 20*a*, 22*a* in the container 10 at opposite ends thereof between the heads of the putters 12, 14 and the cavities for the tee markers 16, 18.

Additionally the game set includes two combination instructional card and golf hole 24, 26 each supported within a vacuum formed rectangular depression 28 formed through the length of the container 10 at a point intermediate each of the putter cavities 12*a*, 14*a*.

Each of the combination instructional card and golf holes 24, 26 have three fold lines 24*a*, 24*b*, 24*c* and 26*a*, 26*b*, 26*c* respectively for folding the combination instructional card and golf holes 24, 26 into a three dimensional configuration for purposes to be discussed.

Each of the combination instructional card and golf holes 24, 26 have a perforated segment 24*e*, 26*e* which are removable to form an opening 30 in each of the holes 24, 26 especially suited as a golf putting target. More particularly, the opening 30 extends across the fold line 24*a*, 26*a* when the boards are flat, hole 26, shown in FIG. 2A. Initially each of the boards is folded as shown in FIG. 2B to form a base 32 and two raised planar 34, 36. The raised surface 34 is inclined in a direction away from the opening 30 and defines a viewing surface on which instructional text for the game can be provided to define a method for using the game implements. The raised surface 36 has side segments 36*a*, 36*b* which define the side walls of a hole segment 30*a* forming the entrance into the putting hole. The hole segment 30*a* has a width slightly greater than the diameter of the golf balls 20, 22 and a height which is greater than such diameters. The hole 30 further has a hole segment 30*b* formed in the base 32 which has an open entrance at ground level to eliminate any bump to interfere with the entry of a properly stroked and aligned ball into an interior space 38 bounded by the surfaces 34, 36 and base 32, The opening 30*b* has a closed exit to capture a golf ball stroked therethrough.

The finished target 40 shown in FIG. 2C is held upright by inserting a tab 42 on one end of the board 24, 26 into a narrow slit 44 on the opposite end of the board 24, 26.

One method for practicing the game includes placing the tee markers 16 and 18 at two different hole locations, e.g. in adjacent rooms. The targets 40 are located a predetermined distance from the tee markers and the game participants take turns putting the ball toward the targets. A putt is sunk when the ball enters the interior space through the hole 30 and the putt is missed when the ball fails to enter the interior space 38.

The method includes a skill level measurement directly related to the clothing on individual participants. More particularly, ball stroking success or failure is rewarded by a skill level measured in clothes retention or loss. Of course, without penalties, a participant remains fully clothed.

Typical game rules are as follows, with it being understood that the method can vary so long as the reward for putts which are sunk into the space 38 is to remain fully clothed and the penalty for a missed putt is the removal of an article of clothing.

(1) Starting attire is a minimum of two (2) garments and a maximum of five (5) garments.
(2) Accessories and jewelry are not garments.
(3) Locate tee markers and holes in rooms as desired.
(4) Minimum hole distance is four (4) feet between tee markers and hole.
(5) Each player must tee off between markers.
(6) First person without garments loses.

While a preferred embodiment of the invention is shown, it should be understood that other equivalents of the target and steps for the method which may be substituted for the components without varying from the present invention. Such equivalents are intended to be included within the scope of the appended claims.

I claim as my invention:

1. A novelty golf game comprising:

a pair of putters and a pair of golf balls;

a putting target including a first inclined planar surface portion thereon adapted to be imprinted with instructional text and said target further including a base portion with a first hole segment with an open entrance and a closed exit and including a second inclined planar surface portion thereon having spaced side segments forming a second hole segment located above and rearwardly of the entrance to said first hole segment and located above and forwardly of the exit of said first hole segment for defining a target hole through which a golf ball can be stroked and captured.

2. A novelty golf game comprising:

a pair of putter and a pair of golf balls;

a putting target including three sides joined at first, second and third apexes two of which are located in a common plane and a third of which is raised from said common plane to form an upright target with a first raised surface facing upwardly and adapted to be printed with game instructions and having two other surfaces defining a flat base located in said common plane and further defining a second raised surface both having an opening therein for defining a putting target hole through which a golf ball can be stroked and captured.

* * * * *